US009527624B1

(12) United States Patent
Phipps et al.

(10) Patent No.: US 9,527,624 B1
(45) Date of Patent: Dec. 27, 2016

(54) CASE MADE FROM DISSIMILAR MATERIALS

(71) Applicant: Helen of Troy Limited, Belleville, St. Michael (BB)

(72) Inventors: Troy Phipps, Brooklyn, NY (US); Shelley Palazzolo, Brooklyn, NY (US); Morris Elijah Worden, IV, New York, NY (US); Marie Gabrielle Yvonne Bachoc, Brooklyn, NY (US); Heidi Serene Farrell, Brooklyn, NY (US); Kirsten Climer, Brooklyn, NY (US); Lauren Argo, San Francisco, CA (US); Alexander Stuhler, Munich (DE)

(73) Assignee: Helen of Troy Limited, Belleville, St. Michael (BB)

( * ) Notice: Subject to any disclaimer, the term of this patent is extended or adjusted under 35 U.S.C. 154(b) by 0 days.

(21) Appl. No.: 14/885,198

(22) Filed: Oct. 16, 2015

(51) Int. Cl.
*B65D 25/04* (2006.01)
*B65D 8/00* (2006.01)

(52) U.S. Cl.
CPC ..... *B65D 15/24* (2013.01)

(58) Field of Classification Search
CPC ..... B65D 15/22; B65D 15/00; B65D 15/24; B65D 25/04
USPC ..... 220/521, 503, 505, 554, 524; 150/115, 150/114, 112; 383/38, 33, 80
See application file for complete search history.

(56) References Cited

U.S. PATENT DOCUMENTS

| | | | | |
|---|---|---|---|---|
| 1,617,994 | A * | 2/1927 | Eaton | A01K 97/20 220/521 |
| 6,412,652 | B1 * | 7/2002 | Woram | B65D 21/086 220/521 |
| 7,055,686 | B2 | 6/2006 | De-Vries | |
| 8,418,852 | B2 | 4/2013 | Ziemba | |
| 2006/0027481 | A1 | 2/2006 | Gelardi et al. | |
| 2009/0321299 | A1 | 12/2009 | Gehring | |

* cited by examiner

*Primary Examiner* — Stephen Castellano
(74) *Attorney, Agent, or Firm* — Rankin, Hill & Clark LLP

(57) ABSTRACT

A case includes a first container, a second container, and a connector. The first container includes a first moveable door and a skirt. The first moveable door moves to selectively provide access to a first storage compartment in the first container. The skirt is made from a first material. The second container is made from a second material that is more pliable than the first material. The second container defines a second storage compartment. The second material is folded over the connector and connected with itself to attach the connector with the second container. An opening is provided in the skirt or in the connector. A barb protrudes from the skirt or from the connector. The barb is received in the opening to connect the connector and the second container with the first container.

20 Claims, 4 Drawing Sheets

CASE MADE FROM DISSIMILAR MATERIALS

BACKGROUND

Cases are used to carry items, and many cases have multiple compartments to facilitate in the organization of carrying dissimilar items in the same case. Sometimes cases are made from dissimilar materials. Attaching these dissimilar materials to each other when manufacturing the case can present issues.

SUMMARY

In view of the foregoing, a case is provided that includes a first container, a second container, and a connector. The first container includes a first moveable door and a skirt. The first moveable door moves to selectively provide access to a first storage compartment in the first container. The skirt is made from a first material. The second container is made from a second material that is more pliable than the first material. The second container defines a second storage compartment. The second material is folded over the connector and connected with itself to attach the connector with the second container. An opening is provided in the skirt or in the connector. A barb protrudes from the skirt or from the connector. The barb is received in the opening to connect the connector and the second container with the first container. As such, a case made from dissimilar materials can be provided.

DETAILED DESCRIPTION

Figure 1:
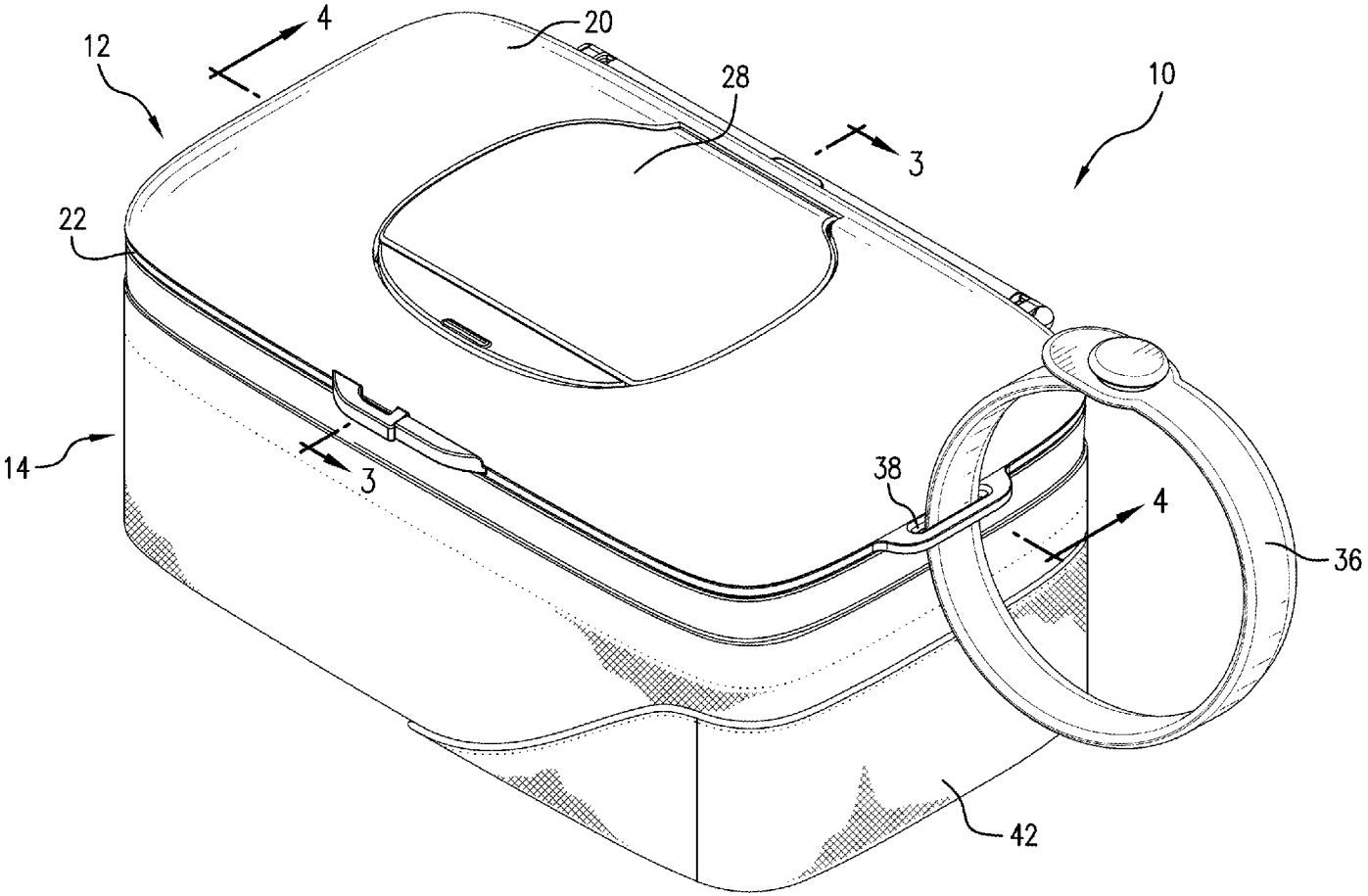
FIG. 1 is a perspective view of a case made from dissimilar materials.

With reference to FIG. 1, a case 10 that can be useful to carry pre-moistened wipes and diapers is shown. The case 10 includes a first container 12 and a second container 14. In the illustrated embodiment, the first container 12 is configured to carry the wipes, and the second container 14 is configured to carry diapers. Nevertheless, the case 10 can be useful to carry other items and can take other configurations to accommodate other items.

The first container 12 includes a shell, which in the illustrated embodiment is made up of an upper shell 20 and a lower shell 22. The first container 12 is similar in configuration to the On-the-Go wipes dispenser available from OXO, with the exception of including a skirt 24 (FIG. 2) that will be described in more detail below. In the illustrated embodiment, an access opening 26 (FIG. 4) is provided in the upper shell 20 and is selectively covered by a first moveable door 28. The upper shell 20 is pivotally connected with the lower shell 22. The upper shell 20 can be pivoted away from the lower shell 22 to allow for loading wipes into a first storage compartment 30 in the first container 12. To remove a wipe from the first storage compartment 30, the first moveable door 28 is pivoted away from the upper shell 20 to provide access to the first storage compartment 30. In the illustrated embodiment, the upper shell 20, the lower shell 22, and the first moveable door 28 are all made from a first material, which in the illustrated embodiment is a rigid plastic material.

Figure 2:
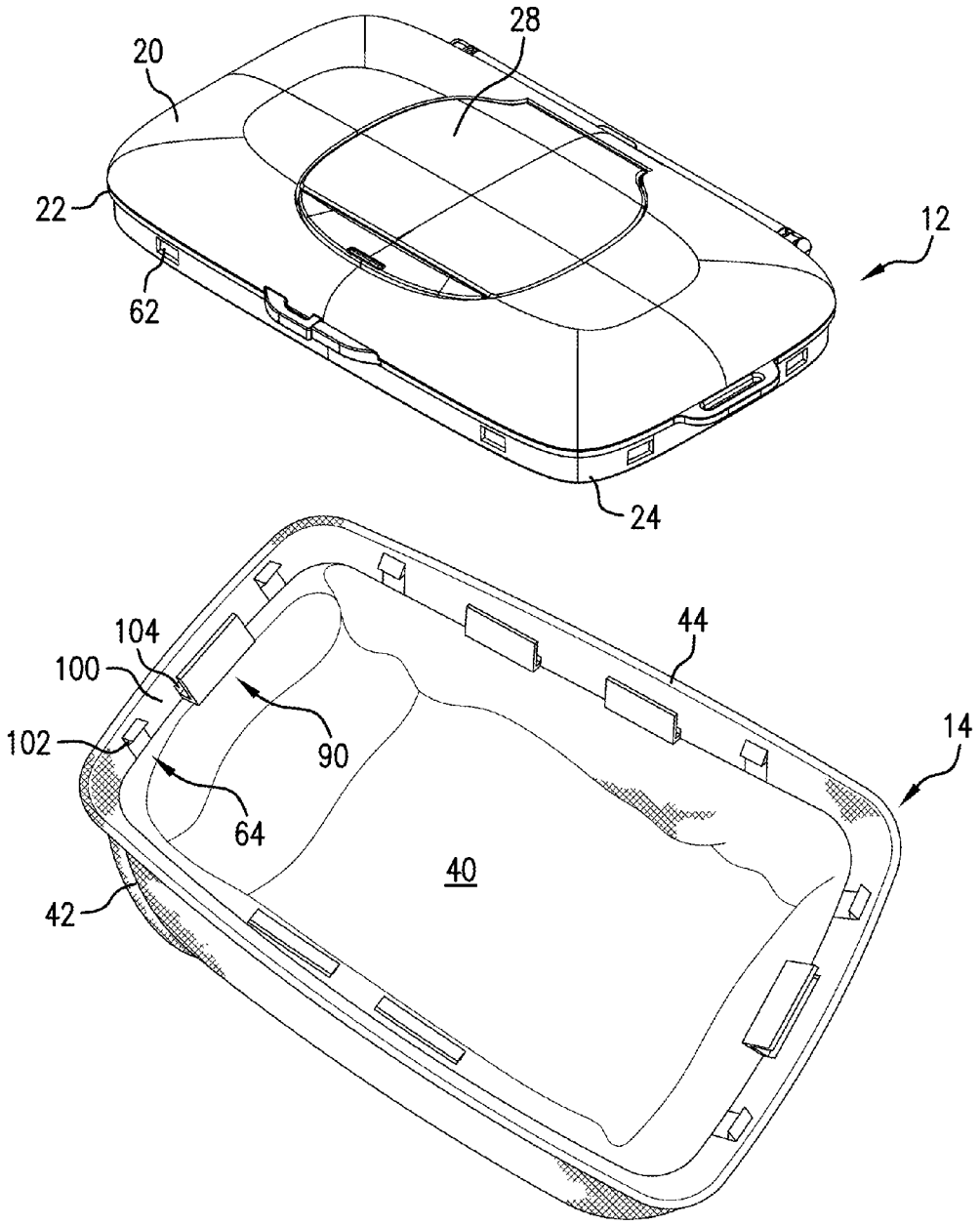
FIG. 2 is an exploded view of the case depicted in FIG. 1.
Figure 3:
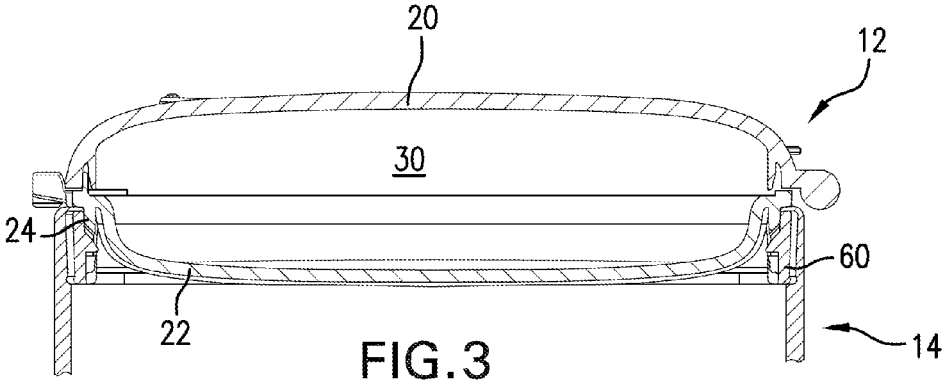
FIG. 3 is a cross-sectional view taken along line 3-3 in FIG. 1.
Figure 4:
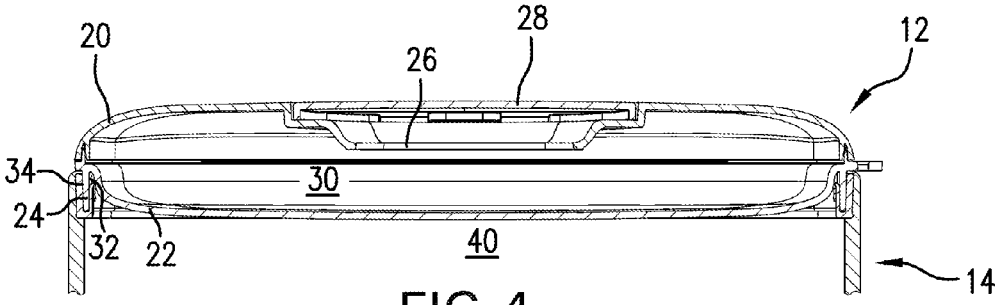
FIG. 4 is a cross-sectional view taken along line 4-4 in FIG. 1.

The skirt 24 is provided to facilitate the connection between the first container 12 and the second container 14. In the illustrated embodiment, the skirt 24 depends from the lower shell 22. As illustrated, the skirt 24 is integrally formed with the lower shell 22. The skirt 24 also surrounds the periphery of the lower shell 22. As illustrated, the skirt 24 is continuous, i.e., a single skirt is provided depending downwardly from the lower shell 22. With reference to FIG. 4, the skirt 24 includes an internal surface 32 and an external surface 34. Both the internal surface 32 and the external surface 34 are smooth and generally planar, except for around corners. The skirt 24 is oriented generally perpendicular to the first moveable door 28 when the first moveable door 28 is in the closed position, which is shown in FIG. 2.

With reference to FIG. 1, a strap 36 connects with the shell through a slot 38 formed in the upper shell 20. The strap 36 allows the case 10 to be attached to other items.

The second container 14 is made from a second material that is more pliable than the first material. In the illustrated embodiment, the second container 14 is made from a fabric material, which allows the second container 14 to compress and take up less space in another bag, such as a diaper bag. With reference back to FIG. 2, the second container 14 defines a second storage compartment 40. More particularly, the lower shell 22 and the second container 14 define the second storage compartment 40. With reference to FIG. 4, the second storage compartment 40 is separated from the first storage compartment 30 by the lower shell 22. The second container 14 operates similar to a pouch and in the illustrated embodiment is configured to store folded diapers.

With reference back to FIG. 1, the second container 14 includes a second moveable door 42 that is moveable to selectively provide access to the second storage compartment 40. Hook and loop fasteners, buttons, and the like can be provided to maintain the second moveable door 42 in the closed position. With reference to FIG. 2, the second container 14 is provided with an open side 44. The open side 44 of the second container 14 surrounds the skirt 24 when the second container 14 is connected with the first container 12.

The case 10 also includes a connector 60 that is used to connect the second container 14 to the first container 12. The material that makes up the second container 14 is folded over the connector 60 and connected with itself to attach the connector 60 with the second container 14. In the illustrated embodiment, the material that makes up the second container 14 is folded over the connector 60 and sewn to itself to attach the connector 60 within the second container 14. The material that makes up the second container 14 can be folded over the connector 60 and connected with itself and other conventional manners, for example through an adhesive. In the illustrated embodiment, material that makes up the second container 14 is folded over the connector 60 at the open side 44. Once the second container 14 is connected with the connector 60, the connector 60 can connect with the skirt 24 to connect the second container 14 with the first container 12.

In the illustrated embodiment, openings 62 are provided in the skirt 24 and barbs 64 are protruding from the connector 60. Each barb 64 is received in a respective opening 62 to connect the connector 60 and the second container 14 with the first container 12. In an alternative arrangement, an opening similar to the opening 62 provided in the skirt can be provided in the connector 60, and a barb similar to the barb 64 can be provided on the skirt 24. In this instance, the barb (similar to the barb 64) would still be received in the opening (similar to the opening n62) to connect the connector 60 and the second container 14 with the first container 12. The connector 60 and the skirt 24 provide for a mechanical connection between the first container 12 and the second container 14 that is designed to be permanent and robust.

Figure 5:
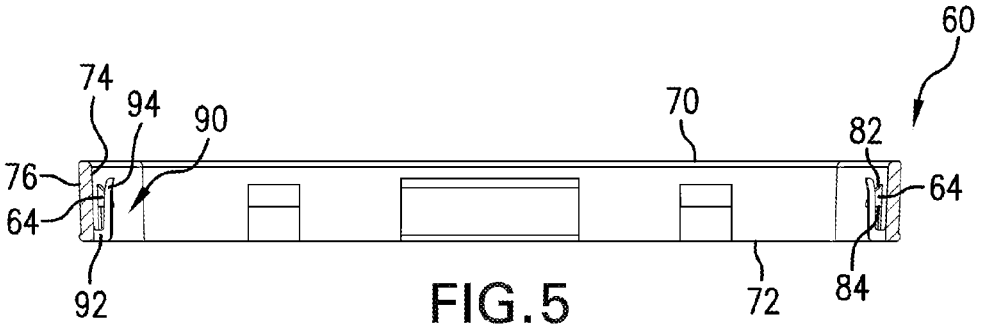
FIG. 5 is a cross-sectional view of a connector of the case taken along line 5-5 in FIG. 2.
Figure 6:
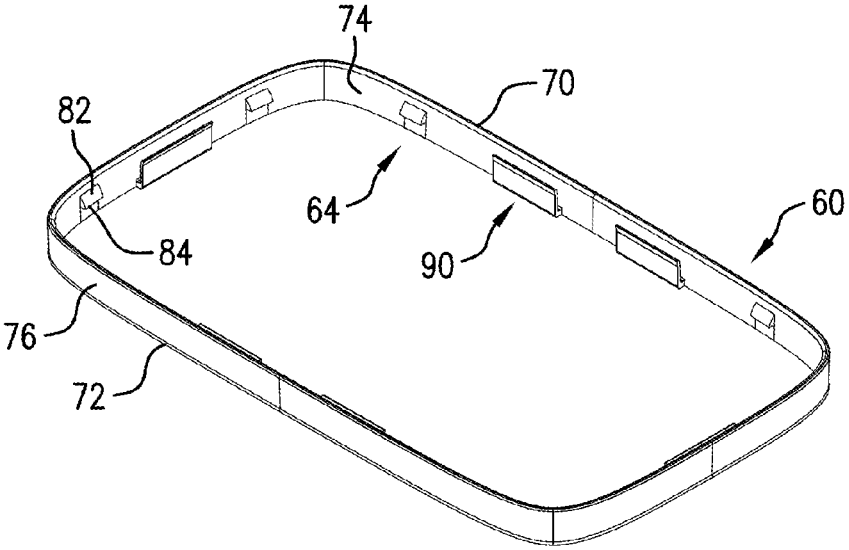
FIG. 6 is a perspective view of the connector shown in FIG. 5.

With reference to FIG. 5, the connector 60 includes an upper edge 70 and a lower edge 72. The connector 60 also includes an inner surface 74 and an outer surface 76. Each barb 64 includes a ramped surface 82 sloped inwardly and downwardly away from the inner surface 74. Each barb 64 also includes a lower barb surface 84 extending inwardly from the inner surface 74. The lower barb surface 84 is substantially planar and normal to the inner surface 74, which is planar in the vicinity of each barb 64.

The connector 60 also includes a flange 90 (a plurality of flanges are provided in the illustrated embodiment) that receives the skirt 24 when the barb 64 is received in the opening 62 to connect the second container 14 with the first container 12. With reference to FIG. 5, each flange 90 includes a lower section 92 and an upright section 94 extending upwardly from a distal end of the lower section 92 toward the upper edge 70 of the connector 60. The lower section 92 extends inwardly from the inner surface 74. More particularly in the illustrated embodiment, the lower section 92 extends inwardly from the lower edge 72. As seen in FIG. 5, each barb 64 extends inwardly from the inner surface 74 farther than the flange 90. This makes removal of the connector 60 from the skirt 24 more difficult once the barbs 64 are received in the respective openings 62 on the skirt 24.

The connector 60 in the illustrated embodiment is a one-piece molded ring-shaped part. In an alternative arrangement, a plurality of connectors could be provided and connected with the second container 14 where the second material, which makes up the second container 14, is folded over each connector and connected with itself to attach the connectors with the second container 14. Each of these connectors could include either a barb, similar to the barb 64, or a flange, similar to the flange 90. Providing the connector 60 as a one-piece molded ring-shaped part, however, provides more rigidity to the connection between the first container 12 and the second container 14.

With reference back to FIG. 2, the second material, which makes up the second container, 14 is folded over the connector 60 and connected with itself providing an inner section 100. The inner section 100 includes barb openings 102. A respective barb 64 extends through each barb opening 102. The inner section 100 also includes a plurality of flange openings 104. A respective flange 90 extends through each flange opening 104. As such, the barbs 64 and the flanges 90 are able to cooperate with the skirt 24 so that the connector 60 and the second container 14 connect with the first container 12 through the skirt 24.

As such, a case made from dissimilar materials, e.g., a rigid plastic and a fabric material, can be provided with a robust connection that is simple and mechanical. A case has been described above with particularity. Although the case has been described as useful for carrying wipes and diapers, other cases made from dissimilar materials could also be made using the connection described above. Modifications and alterations will occur to those upon reading and understanding the preceding detailed description. The invention, however, is not limited to only the embodiments described above. Instead, the invention is broadly defined by the appended claims and the equivalents thereof.

The invention claimed is:

1. A case comprising:

a first container including a first movable door and a skirt, wherein the first movable door is movable to selectively provide access to a first storage compartment in the first container, and the skirt is made from a first material;

a second container, which is made from a second material that is more pliable than the first material, defining a second storage compartment; and a connector, wherein the second material is folded over the connector and connected with itself to attach the connector with the second container, an opening provided in the skirt or in the connector; and a barb protruding from the skirt or from the connector, wherein the barb is received in the opening to connect the connector and the second container with the first container.

2. The case of claim 1, wherein the first container includes a shell made from the first material.

3. The case of claim 1, wherein the first container includes an upper shell and a lower shell, wherein an access opening is provided in the upper shell and is selectively covered by the first movable door.

4. The case of claim 3, wherein the lower shell and the second container define the second storage compartment, which is separated from the first storage compartment by the lower shell.

5. The case of claim 4, wherein the skirt depends from the lower shell.

6. The case of claim 5, wherein the skirt is integrally formed with the lower shell.

7. The case of claim 3, wherein the upper shell is pivotally connected with the lower shell.

8. The case of claim 1, wherein the connector includes an upper edge and a lower edge, wherein the barb includes a ramped surface sloped inwardly and downwardly away from an inner surface and a lower barb surface extending inwardly from the inner surface.

9. The case of claim 8, wherein the lower barb surface is substantially planar and normal to the inner surface.

10. The case of claim 1, wherein the connector includes a flange that receives the skirt when the barb is received in the opening to connect the second container with the first container.

11. The case of claim 10, wherein the connector includes an upper edge and a lower edge, wherein the flange includes a lower section and an upright section extending upwardly from a distal end of the lower section toward the upper edge, wherein the lower section of the flange extends inwardly from the lower edge of the connector.

12. The case of claim 10, wherein the barb and the flange extend inwardly from an inner surface of the connector, and the barb extends inwardly farther than the flange.

13. The case of claim 1, wherein the connector is a one-piece molded ring-shaped part.

14. The case of claim 1, wherein the second material is folded over the connector and connected with itself at an open side surrounding the connector.

15. The case of claim 14, wherein the first container includes a shell made from the first material, and the open side of the second container surrounds the skirt.

16. The case of claim 15, wherein the first material is a rigid plastic and the second material is a fabric.

17. The case of claim 16, wherein the second container includes a second movable door that is movable to selectively provide access to the second storage compartment.

18. The case of claim 1, wherein the second material is folded over the connector and connected with itself providing an inner section, wherein the inner section includes a barb opening in the inner section through which the barb extends.

19. The case of claim 18, wherein the connector includes a flange that receives the skirt when the barb is received in the opening to connect the second container with the first container, wherein the inner section includes a flange opening in the inner section through which the flange extends.

20. The case of claim 19, wherein the first material is a rigid plastic and the second material is a fabric, wherein the second container includes a second movable door that is movable to selectively provide access to the second storage compartment.

* * * * *